US005351848A

United States Patent [19]

Wagoner

[11] Patent Number: 5,351,848

[45] Date of Patent: Oct. 4, 1994

[54] PERIPHERAL SEAL DEVICE FOR FLOATING TANK COVER

[75] Inventor: Robert B. Wagoner, Broken Arrow, Okla.

[73] Assignee: Matrix Service, Inc., Tulsa, Okla.

[21] Appl. No.: 115,816

[22] Filed: Sep. 3, 1993

[51] Int. Cl.[5] ..... B65D 88/46

[52] U.S. Cl. ..... 220/224; 220/221

[58] Field of Search ..... 220/216, 218, 221, 222, 220/224

[56] References Cited

U.S. PATENT DOCUMENTS

| | | | |
|---|---|---|---|
| 2,576,136 | 11/1951 | Moyer | 220/224 |
| 2,634,017 | 4/1953 | Moyer | 220/222 |
| 2,855,122 | 10/1958 | Ulm et al. | 220/219 |
| 2,897,998 | 8/1959 | Ulm | 220/224 |
| 2,960,252 | 11/1960 | Ulm | 220/224 |
| 3,589,549 | 6/1971 | Heisterberg | 220/222 |
| 4,036,395 | 7/1977 | Tuckey | 220/224 |
| 4,154,359 | 5/1979 | Bissett | 220/222 |
| 4,540,104 | 9/1985 | Kawai et al. | 220/224 |
| 5,036,995 | 8/1991 | Wagoner | 220/224 |

*Primary Examiner*—Allan N. Shoap
*Assistant Examiner*—Vanessa Caretto
*Attorney, Agent, or Firm*—Head and Johnson

[57] ABSTRACT

A device for sealing the rim space between a floating cover, movably disposed within a storage tank, and the inner wall of the storage tank. The device includes a peripheral sealing ring formed of a plurality of overlapped shoe segments, each segment having a first and second opposed edge to overlap with adjacent segments. Countersunk apertures are provided in each shoe segment, one aperture near the first edge. A fastener extends through each aperture so that a head of the fastener will reside within a recess formed by the countersunk aperture. At least one movable rod extends past the first edge. A clip for each fastener has a space for slidably receiving the rod, each second side free to slidably overlap the first side and the fastener.

4 Claims, 3 Drawing Sheets

PERIPHERAL SEAL DEVICE FOR FLOATING TANK COVER

BACKGROUND OF THE INVENTION

1. Field of the Invention

The present invention relates to sealing devices for the rim space between the inner wall of a storage tank and the periphery of a floating cover therein. Specifically, the present invention relates to improvements in the mechanism to allow shoe segments of the sealing ring to overlap.

2. Prior Art

Bulk fluids such as petroleum and fuel products are usually stored in large cylindrical storage tanks. These are commonly designed with floating covers to minimize product losses to the atmosphere. A critical part of the floating cover is the sealing mechanism that is installed in the annular or rim space between the floating cover and the inner wall of the storage tank.

A rim space sealing device is disclosed in Applicant's and Assignee's patent (U.S. Pat. No. 5,036,995) entitled "Peripheral Seal for Floating Tank Cover" which is incorporated herein by reference. A series of shoes disposed around the periphery of the tank wall are frictionally engaged with the wall. Adjacent shoes are allowed to overlap a certain distance. As seen in FIG. 11 on sheet No. 4, the vertical movement of the overlapping shoe segments in relation to each other is limited by a series of retainer rods 82. The retainer rods are held in place by upper clips 58 having opposed legs that form a space for a clamping channel. The attachment point of the clamping channels at the joint must be outside the lapped area shown by arrow 38.

Typically, the sealing mechanism is assembled and installed on site in the field from components. The holes or openings for fasteners are also shop fabricated in advance. If the components are assembled with the laps of the shoes reversed the flexible shoes might possibly be caused to bind. This would limit the optimum expansion flexibility of the joint.

It is, therefore, a principal object and purpose of the present invention to provide a peripheral seal device wherein the overlapping shoe segments may be field assembled in one way only.

It is a further object and purpose of the present invention to provide a peripheral seal device wherein clips at one side edge are attached only to a single shoe so that the adjacent shoe is free to overlap without restriction.

SUMMARY OF THE INVENTION

The present invention provides a device for sealing the rim space between the cylindrical tank wall and a floating cover.

A series of flexible shoes are arranged and disposed and frictionally engaged with the interior periphery of the tank wall. The flexible shoes are overlapped to form a sealing ring completely encircling in the inner circumference of the tank wall. The top edge of each shoe is bent inward as is the bottom edge allowing the sealing ring to slide up and down the inner tank wall without catching on imperfections or irregularities in the contour of the tank wall. The inward bends also control and limit the vertical movement of the overlapping shoe segments.

The space between the sealing ring of shoe segments and the outer wall of the floating cover is sealed by a flexible material. The outer edge of the flexible material is fastened to the shoes by a series of adjacent upper fabric clips.

Each shoe segment contains a first side edge and an opposed parallel side edge, each of which is perpendicular to the top and lower bends of the shoe. Each shoe contains a series of aligned countersunk apertures to receive fasteners for the upper clips. One aperture is located near the first edge so that the first edge of the adjacent shoe will be allowed to overlap without interfering therewith.

A fastener will pass through each clip aperture so that the head of the fastener resides within the countersunk portion of the aperture. The upper fabric clip is retained in place by the fastener and by a nut secured thereto. The second edge of the adjacent shoe is thus free to overlap and slidably pass the first edge on the adjacent shoe.

A pair of parallel rods extend past the first edge of the shoe and reside within a space created between the upper clip and the shoe. A pair of parallel rods are movably retained within the space formed by opposed legs of the clip.

At an elevation below the fabric clip location and extending across the area of overlap are a pair of retention plates which are bolted or otherwise affixed to the shoe segment near but spaced from the second edge. Each retention plate and its connected shoe forms an expansion and contraction space. The retention plate is formed with a flat contact section and a pair of perpendicular legs to provide extra stability.

The upper clip fastener passes through the countersunk aperture so that the fastener head is beneath or flush with the surface of the shoe. The clip is retained in place by the fastener and its accompanying nut. A pair of parallel rods are movably retained within the space formed by opposed legs of the clip.

DETAILED DESCRIPTION OF THE PREFERRED EMBODIMENT

Figure 1:
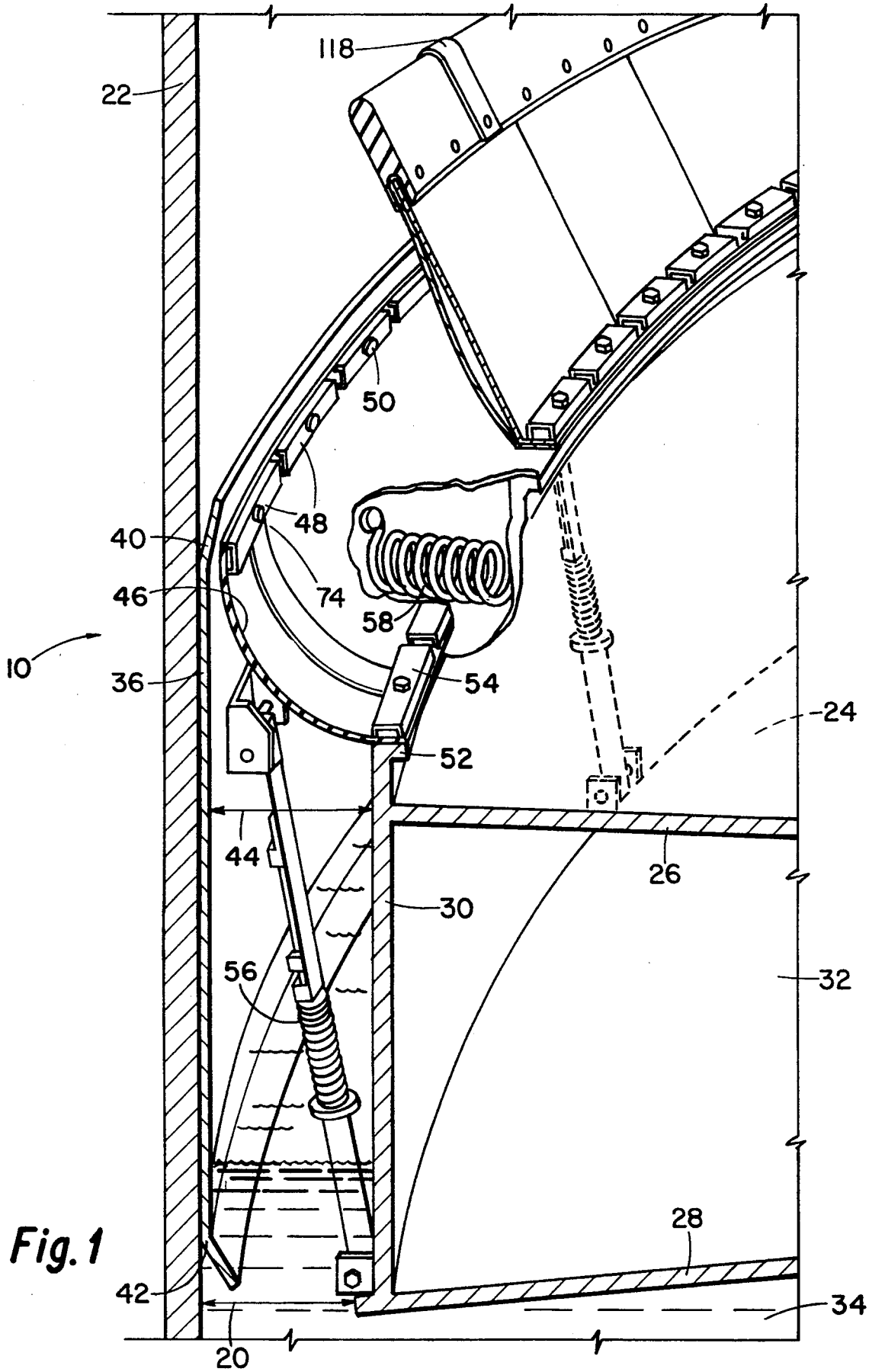
FIG. 1 is a sectional view of a device for sealing the rim space between a cylindrical tank wall and a floating cover constructed in accordance with the present invention.

Referring to the drawings in detail, FIG. 1 illustrates a device 10 for sealing the rim space 20 between a cylindrical tank wall 22 and a floating cover 24. The floating cover 24 has a top plate 26, a bottom plate 28, and an outer wall 30 enclosing an air space 32 so that the cover 24 is buoyant and floats on the liquid contents of a storage tank. This seal can also be attached to a steel pan roof that has only a bottom plate 28 and outer wall 30.

A series of flexible shoes 36 are arranged and disposed around the periphery of the tank wall 22 and are frictionally engaged with the tank wall 22. The flexible shoes 36 are overlapped at approximately 10 to 12 foot intervals to form a sealing ring that completely encircles the inner circumference of the tank wall 22. The top edge of each shoe segment 36 is bent inward at 40 as is the bottom edge at 42, allowing the sealing ring of shoe segments 36 to slide up and down the inner tank wall without danger of the edges catching on imperfections or irregularities in the contour of the tank wall. The inward bends 40 and 42 also control and limit the vertical movement of the overlapping shoe segments 36 with respect to each other.

The space, illustrated by arrow 44, between the sealing ring of the shoe segments 36 and the outer wall 30 of the floating cover is sealed by a flexible material 46 which may be composed of fabric, plastic or other flexible material. The outer edge of the flexible material 46 is fastened to the shoes 36 by a series of adjacent upper fabric clips 48. The upper clips 48 are secured to the shoes by fasteners such as bolts 50.

The inner edge of the flexible material 46 is connected to a rim plate 52 on the upper edge of the outer wall 30 of the floating cover 24. A series of lower fabric clips 54 connect the flexible material 46 to this rim plate 52.

The sealing ring comprised of the overlapping shoe segments 36 is urged outward and upward by a series of spring loaded hanger pushers 56 which are attached to the lower edge of the outer wall 30 and to the shoe.

A series of horizontal pusher springs 58 also provides outward pressure on the sealing ring of shoe segments.

Figure 2:
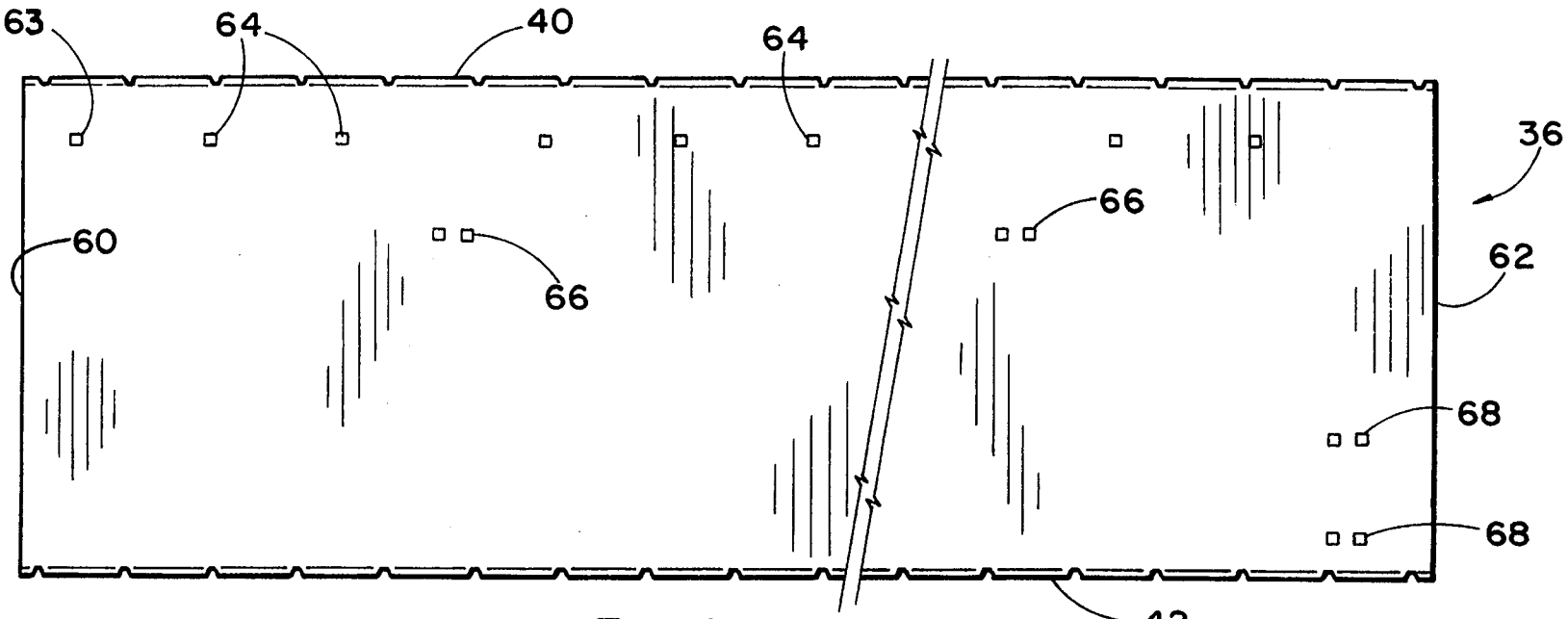
FIG. 2 is a perspective view of a flexible shoe which is part of the device for sealing a rim space shown in FIG. 1.

FIG. 2 shows one of the flexible shoes 36 apart from the sealing device 10. Each shoe segment 36 contains a first side edge 60 and an opposed parallel second sided edge 62. The side edges are perpendicular to the top and lower bends 40 and 42.

The shoe 36 contains a series of aligned counter-sunk clip apertures 63 and 64 to receive the fasteners 50 for the upper clips 48 (not shown in FIG. 2). Aperture 63 is near the first edge 60 so that the second edge 62 of the adjacent shoe will be allowed to overlap as will be described herein. Hanger apertures 66 are used to receive fasteners for the hanger pusher 56 (not shown in FIG. 2). Counter-sunk apertures 68 are used for attaching retention plates to be described herein.

Figure 3:
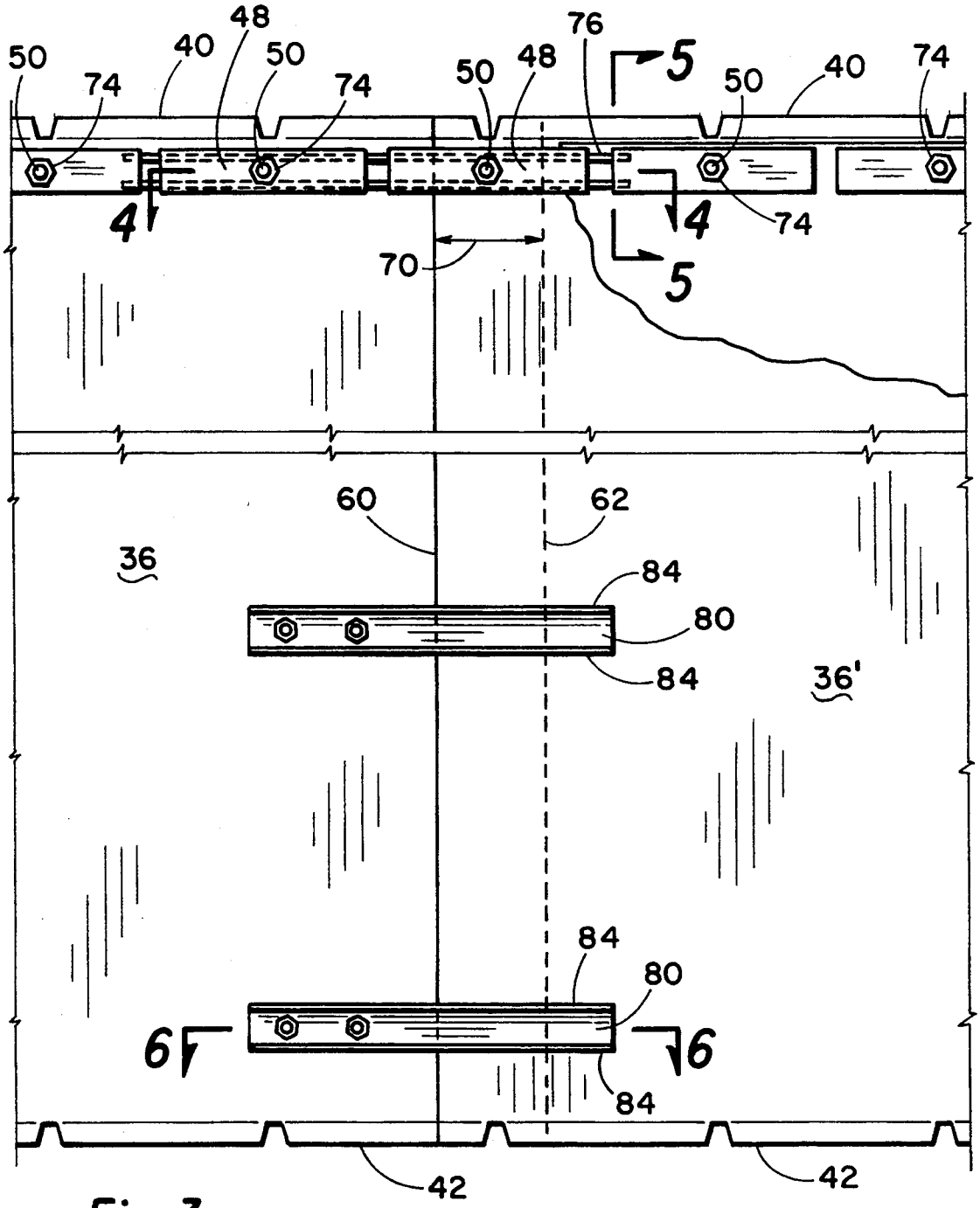
FIG. 3 is a partial view of a pair of adjacent shoe segments which are a part of the device for sealing a rim space shown in FIG. 1.

FIG. 3 illustrates a pair of shoe segments 36 and 36' which are overlapped the distance shown at arrow 70. The overlap distance will depend on the spacing between fasteners 50. The first edge 60 of shoe 36' is visible in FIG. 3, while the overlapped second edge of the adjacent shoe panel 36 slides beneath and is illustrated by dashed line 62.

Fabric clip 48 is retained in place by bolt 50 which passes through aperture 63 near the first edge.

Figure 4:
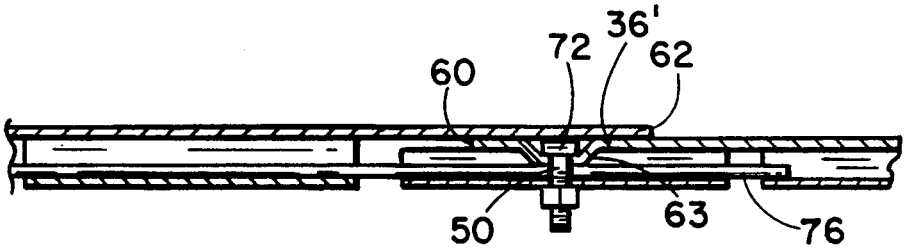
FIG. 4 is a sectional view taken along section line 4—4 of FIG. 3.

FIG. 4 is a sectional view taken along section line 4—4 of FIG. 3. Fastener 50 passes through clip aperture 63 near the first edge 60 of shoe 36'. The head 72 of the fastener 50 resides within the counter-sunk portion of the aperture 63. The upper fabric clip 48 is retained in place by the fastener 50 having nuts 74. It will, thus, be seen that the second edge 62 of the adjacent shoe 36 is free to overlap and slidably pass the first edge 60 on the adjacent shoe without binding on the bolt 50.

A pair of rods 76 extend past the first edge 60 of shoe 36' and reside within a space created between the upper clip 48 and the shoe 36. The rods extend and are slidably received in a clip 48 offset from the second edge of the shoe 36.

At an elevation below the fabric clip location and extending across the area of overlap 70 are a pair of parallel retention plates 80 which are bolted or otherwise affixed to the shoe segment 36 near but spaced from the second edge 62. The retention plate apertures 68 is recessed so that the elevation provided offers a space. Each retention plate 80 and its connected shoe forms an expansion and contraction space. The length of the retention plates 80 is greater than the maximum distance of the overlap 70. The retention plate 80 is formed with a flat contact section and a pair of perpendicular legs 84 to provide extra stability.

Figure 5:
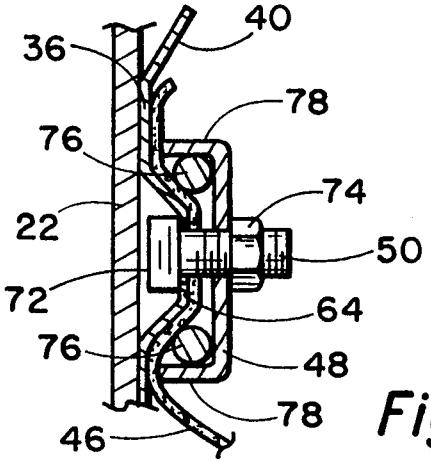
FIG. 5 is a sectional view taken along section line 5—5 of FIG. 3.

FIG. 5 is a cross-section taken along section line 5—5 of FIG. 3. The flexible material 46 is retained in place by the upper fastener clip 48. The fastener 50 passes through the counter-sunk aperture 64 so that the fastener head 72 is beneath or flush with the surface of the shoe 36. The clip 48 is retained in place by the fastener 50 and accompanying nut 74. A pair of parallel rods 76 are movably retained within the space formed by opposed legs 78 of the clip 48.

Figure 6:
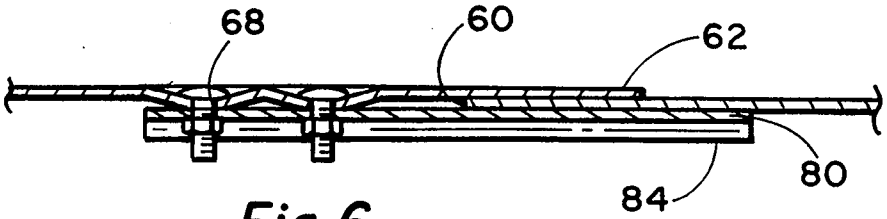
FIG. 6 is a sectional view taken along section line 6—6 of FIG. 3.

FIG. 6 is a cross-section taken along section line 6—6 of FIG. 3, illustrating the retention plate 80. As seen in FIG. 3, a pair of retention plates are utilized. The retention plate 80 is secured to shoe 36 near the second edge 62 and presses against the adjacent section near the first edge 60.

Whereas, the present invention has been described in relation to the drawings attached hereto, it should be understood that other and further modifications, apart from those shown or suggested herein, may be made within the spirit and scope of this invention.

What is claimed is:

1. A device for sealing a rim space between a floating cover, movably disposed within a storage tank, and an inner wall of the storage tank, which device comprises:

a. a peripheral sealing ring formed of a plurality of overlapped shoe segments, each segment having first and second opposed side edges and opposed top and bottom edges, the first edge of each shoe segment overlapping the second edge of an adjacent shoe segment;

b. at least three countersunk apertures in each of said shoe segments, aligned in a single horizontal plane parallel to the top edge one said aperture being spaced a first distance from said first edge of each of said shoe segments, a second said aperture being spaced from said second edge of each said shoe segments a second distance substantially greater than said first distance, said second distance being free of apertures in said plane, c. a fastener extending through each said countersunk aperture, a head portion of said fastener residing within a recess formed by each said countersunk aperture;

d. at least one movable rod extending past each said shoe segment first edge; and e. a rigid, elongated clip for each said fastener, each clip having opposed paralleled legs and having a space between said opposed legs for slidably receiving a said rod, each said clip having opposed ends and being secured by a said fastener received in each said one aperture near said first edge of each of said shoe segments wherein one end of said clip extends past said shoe segment first edge to overlap a portion of an adjacent shoe segment so that said shoe segments are assembled to form said peripheral seal ring only with said first edge of each said shoe segments overlapping said second edge of an adjacent shoe segment.

2. A device for sealing the rim space of a storage tank as set forth in claim 1 including a flexible material to cover a space between said peripheral sealing ring of lapped shoe segments and an outer edge of said floating cover.

3. A device for sealing the rim space of a storage tank as set forth in claim 1 wherein said flexible material is secured to said peripheral sealing ring by said clips.

4. A device for sealing the rim space of a storage tank as set forth in claim 1 including a pair of bars fastened to one side edge of each said shoe segment forming an expansion and contraction space for the overlapping portion of an adjacent shoe segment.

* * * * *